US011786793B1

(12) United States Patent
Bell

(10) Patent No.: US 11,786,793 B1
(45) Date of Patent: Oct. 17, 2023

(54) MAGNETIC SWIMMER RESTRAINT DEVICE

(71) Applicant: Douglas Bell, Los Angeles, CA (US)

(72) Inventor: Douglas Bell, Los Angeles, CA (US)

( * ) Notice: Subject to any disclaimer, the term of this patent is extended or adjusted under 35 U.S.C. 154(b) by 113 days.

(21) Appl. No.: 17/586,472

(22) Filed: Jan. 27, 2022

(51) Int. Cl.
*A63B 69/12* (2006.01)
*A63B 21/005* (2006.01)
*A63B 21/00* (2006.01)

(52) U.S. Cl.
CPC ..... *A63B 69/12* (2013.01); *A63B 21/0052* (2013.01); *A63B 21/4013* (2015.10); *A63B 21/4025* (2015.10)

(58) Field of Classification Search
CPC ... A63B 69/12; A63B 21/005; A63B 21/0051; A63B 21/0052; A63B 21/4001; A63B 21/4009; A63B 21/4011; A63B 21/4013; A63B 21/4015; A63B 21/4017; A63B 21/4019; A63B 21/4021; A63B 21/4025
See application file for complete search history.

(56) References Cited

U.S. PATENT DOCUMENTS

| | | | | |
|---|---|---|---|---|
| 7,442,151 | B1 | 10/2008 | Berdegue | |
| 10,076,696 | B2 | 9/2018 | Laflamme et al. | |
| 11,278,782 | B2 * | 3/2022 | McCagg | A63B 21/018 |
| 2006/0098772 | A1 * | 5/2006 | Reho | A63B 71/0686 482/8 |
| 2021/0402256 | A1 * | 12/2021 | Huch | A63B 24/0062 |

* cited by examiner

*Primary Examiner* — Megan Anderson
(74) *Attorney, Agent, or Firm* — SANCHELIMA & ASSOCIATES, P.A.; Christian Sanchelima; Jesus Sanchelima

(57) ABSTRACT

A magnetic swimmer restraint device including a magnetic cone assembly, a strap assembly, a bracelet remote assembly, and a pool assembly is disclosed. These assemblies in conjunction with one another provide a user with a portable restraining system for increased resistance swimming. A wearable strap assembly interacts with magnetic cone assembly that can be located on the lateral sides of a pool or in the pool itself. As a user swims past the magnetic cone assembly the wearable strap assembly becomes magnetically attracted to the magnetic cone assembly. The magnetic attraction of the strap assembly worn by the user to the magnetic cone assembly pulls the user towards the magnetic cone assembly. Thereby increasing swimming resistance. The magnet of the magnetic cone assembly may be an electromagnetic system to be turned on and off via a bracelet remote assembly.

10 Claims, 4 Drawing Sheets

MAGNETIC SWIMMER RESTRAINT DEVICE

BACKGROUND OF THE INVENTION

1. Field of the Invention

The present invention relates to a magnetic swimmer restraint device and, more particularly, to a magnetic swimmer restraint device that restricts the movement of the swimmer by interacting with magnetic cones.

2. Description of the Related Art

Several designs for a magnetic swimmer restraint device have been designed in the past. None of them, however, include a swimmer restraining system comprising a wearable magnetic device which interacts with magnetic cones.

Applicant believes that a related reference corresponds to U.S. Pat. No. 10,076,696 for a swim-in-place swimming pool system that creates a current to restrain the forward movement of the swimmer, wherein the current speed is controlled via a wearable control monitor. Applicant believes another related reference corresponds to U.S. Pat. No. 7,442,151 for an apparatus for restraining the forward progression of a swimmer. None of these references, however, teach of a magnetic swimmer restraint device designed to increase swimming resistance on a swimmer by interacting with magnetic cones.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a magnetic swimmer restraint device that enables swimmers to exercise with limited amount of pool space.

It is another object of this invention to provide a magnetic swimmer restraint device that increases the swimming resistance of a swimmer.

It is still another object of the present invention to provide a magnetic swimmer restraint device that consists of ankle bracelets worn by a swimmer and a system of cones with internal magnets that interact with the ankle bracelets.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

V. DETAILED DESCRIPTION OF THE EMBODIMENTS OF THE INVENTION

Figure 1:
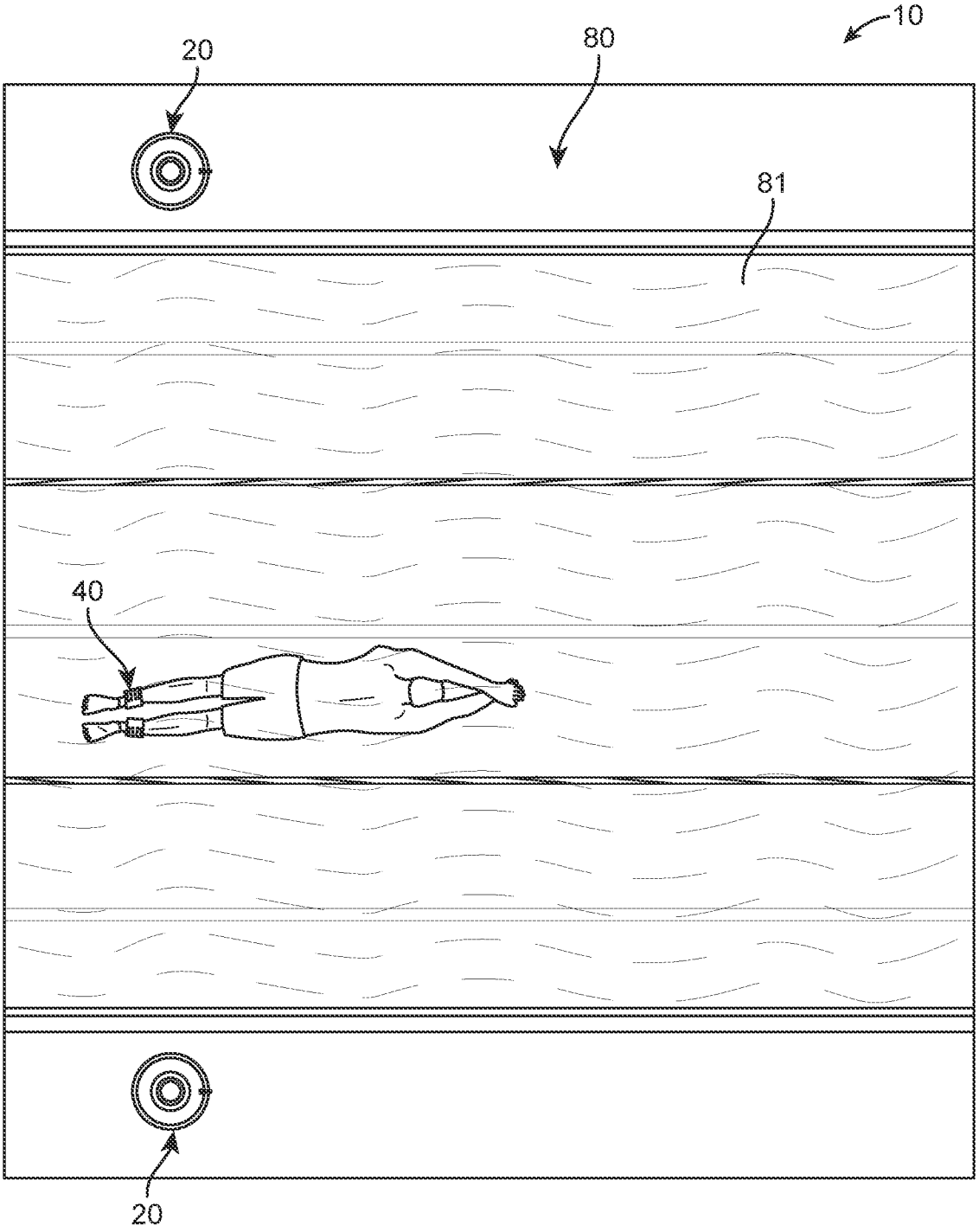
FIG. 1 represents an operational view with a user wearing strap assembly 40 and magnet cone assembly 20 outside of the pool 81.

Referring now to the drawings, where the present invention is generally referred to with numeral 10, it can be observed that it basically includes a magnetic cone assembly 20, a strap assembly 40, and a pool assembly 80.

Figure 2:
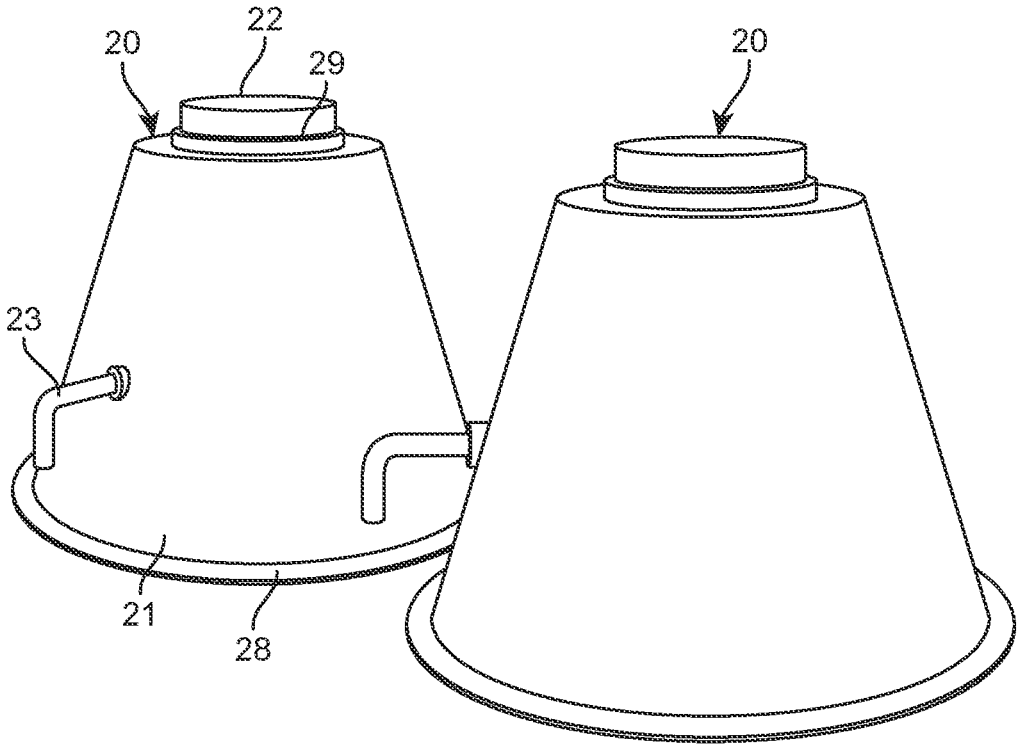
FIG. 2 shows an isometric view of magnetic cone assembly 20.
Figure 3:
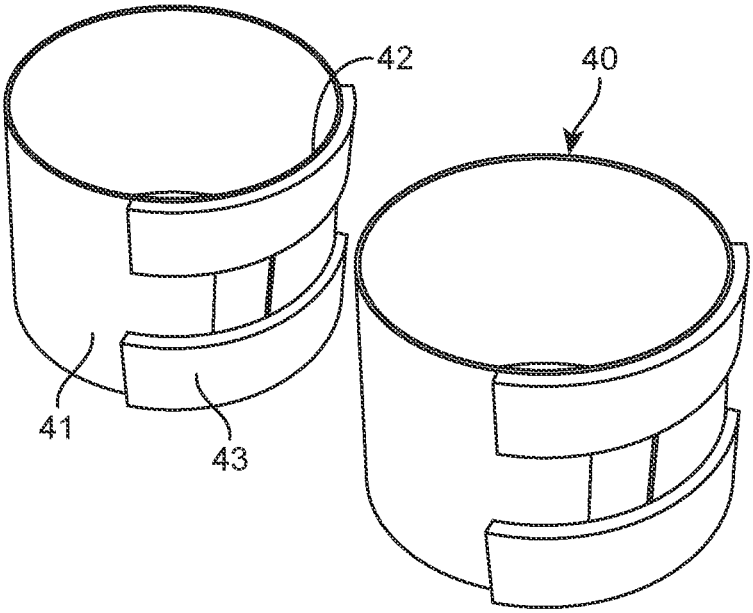
FIG. 3 illustrates an isometric view of strap assembly 40.
Figure 4:
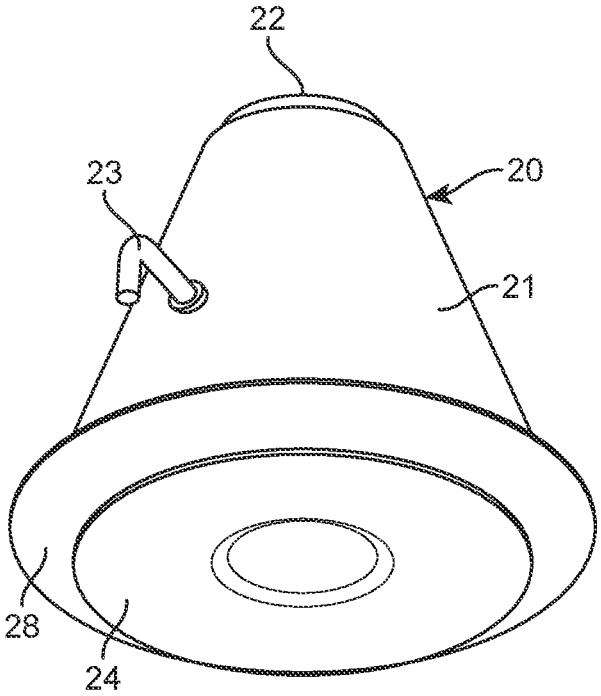
FIG. 4 is a representation of a bottom view of magnetic cone 21 showing fastener 24.
Figure 5:
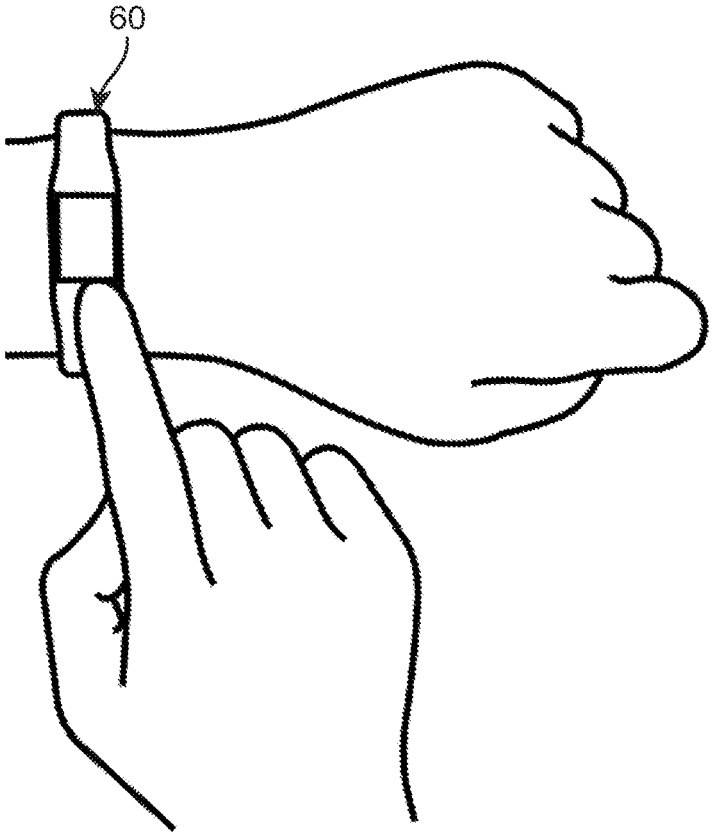
FIG. 5 depicts a user wearing bracelet remote assembly 60.

As illustrated in FIGS. 2, and 4 magnetic cone assembly 20 includes a magnetic cone body 21. Magnetic cone body 21 may be made of a rigid material. The magnetic cone body 21 may have frustoconical shape with a cone lip 28 extending outwardly about the circumference of the base. The cone lip 28 may provide added stability to the magnetic cone body 21 by giving the magnetic cone body 21 a wider base. This allows the magnetic cone assembly 20 to remain in the user's desired location. Attached to the bottom portion of the magnetic cone body 21 may be a fastener 24. Magnetic cone body 21 may also have a lever 23 protruding from its side wall. In one embodiment the lever 23 may be pushed up or down to actuate the fastener 24. In an alternate embodiment the lever 23 may be rotalbly mounted to magnetic cone body 21. The rotation of lever 23 may actuate the fastener 24 up and down. When the fastener 24 is in the up position the fastener 24 may release the surface the magnetic cone body 21 was placed upon. When the fastener 24 is in the down position the fastener 24 may secure the magnetic cone body 21 to a surface. The securing and releasing action of the fastener 24 affords the user the ability to use the present invention with a multitude of pool 81 shapes and sizes.

The top truncated portion of the magnetic cone body 21 may serve as a base for the magnet 22. The top flat portion of the magnetic cone body 21 may include a top cone lip 29. The top cone lip 29 may protrude perpendicularly to the top flat portion of magnetic cone body 21. The top cone lip 29 may be in constant abutting contact with the lateral sides of the magnet 22. Magnet 22 may be provided as an electromagnetic system. Magnet 22 may be electrically powered. It may be suitable for the magnet 22 to be powered via a battery or a power cable connected to an electrical outlet. It may be suitable for magnetic cone assembly 20 to also include a wireless communication module to communicate with a power button on a bracelet remote assembly. It may be preferable for magnetic cone assembly 20 to be a system of multiple magnetic cone body 21 including a first cone and second cone. Wherein the first cone and second cone are placed on lateral sides of a pool 81. The magnetic cone assembly 20 may also be waterproof so that it may be placed inside of the pool 81 while preventing any damage to the electrical components of the electromagnetic system. Housed within magnetic cone body 21 may be a motion detector. Said motion detector may be included in the first cone while being in alignment with the second cone. The motion detector may detect a user swimming within a predetermined proximity to the magnetic cone body 21. Said motion detector may then actuate the electromagnetic system of magnet 22. The magnetic cone assembly 20 may provide a magnetic field strong enough to interact with the strap magnet 43 of strap assembly 40. Magnet 22 may also be actuated by controlling the electromagnet power source via a power button of the bracelet remote assembly.

Strap assembly 40 includes a strap body 41, a strap fastener 42 and a strap magnet 43. Strap body 41 may be made of a pliable material. The strap body 41 may be secured to a user via a strap fastener 42. The strap fastener 42 may take the form of a hook and loop fastener, zipper, or clasp. The strap body 41 may be adapted to wrap around a user's ankle. The strap body 41 may include a strap magnet 43. Strap magnet 43 may provide resistance as a user swims through the magnetic field created by magnet 22. The increase in swimming resistance allows the user to receive a more intense workout within a limited pool 81 space.

Bracelet remote assembly 60 may include a bracelet remote body 62, a power button, a battery, and a bracelet fastener. The bracelet remote body may be made of a pliable material. The bracelet remote body may be secured on a user's person via a bracelet fastener. In one iteration the bracelet fastener may be a hook and loop fastener. The bracelet remote body may serve as a housing for a power button. The power button may allow the user to turn on and off the electromagnetic system of magnet 22. The power button being located on a bracelet remote body enables the user to have a convenient control point while swimming in the pool. It may be preferable for the bracelet remote body to be waterproof for use within the pool 81.

Pool assembly 81 may include pool 81. The pool 81 may take the form of any artificial body of water. The pool 81 may have outer surface edges that multiple magnetic cone assembly 20 can be placed upon. When multiple magnetic cone assembly are placed near the borders of a pool 81, the user may activate the electromagnetic system of magnet 22 via bracelet remote assembly. As the user's proximity to the magnetic field of magnetic cone assembly 20 decreases the strap assembly 40 worn by a user is attracted to magnet 22. As a user swims past magnetic cone assembly 20 this attraction between the strap assembly 40 and magnet 22 may pull the user in the opposite direction they are swimming in. Thereby increasing swim resistance and workout intensity.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a magnetic swimmer restraint device, comprising:

a) a magnetic assembly including a magnetic body, said magnetic body including an electromagnet and a motion detector housed therein, the electromagnet including a power source, said electromagnet creating a magnetic field actuated by the motion detector; and b) a wearable strap assembly including a strap magnet that interacts with said magnetic field of the electromagnet, wherein said strap magnet is configured to be mounted to an ankle of a swimmer, the strap magnet restricting the movement of the swimmer by interacting with said electromagnet via an electromagnetic force.

2. The system for the magnetic swimmer restraint device of claim 1 wherein said fastener is a suction cup.

3. The system for the magnetic swimmer restraint device of claim 2 wherein said fastener is actuated by a lever perpendicularly protruding from a lateral surface of said magnetic body.

4. The system for the magnetic swimmer restraint device of claim 1 wherein said magnetic body is a frustoconical shape.

5. The system for the magnetic swimmer restraint device of claim 1 wherein said power source is a battery.

6. The system for the magnetic swimmer restraint device of claim 1 wherein said power source is a power cable connected to an electrical outlet.

7. The system for the magnetic swimmer restraint device of claim 1 wherein said magnetic body is mounted to a surface via a fastener located at a base.

8. The system for the magnetic swimmer restraint device of claim 1 wherein said power source is controlled by a wearable wristband including a power button.

9. A system for a magnetic swimmer restraint device, comprising:

a) a magnetic assembly including a magnetic body, said magnetic body having a frustoconical shape, the magnetic body including an electromagnet and a motion detector housed therein, the electromagnet including a battery, said electromagnet creating a magnetic field actuated by the motion detector; and b) a wearable strap assembly including a strap magnet that interacts with said magnetic assembly, the strap magnet restricting the movement of the swimmer by interacting with said electromagnet via an electromagnetic force.

10. A system for a magnetic swimmer restraint device, consisting of:

a) a magnetic assembly including a magnetic body, said magnetic body having a frustoconical shape, wherein said magnetic body includes a top portion and a base, the base including a suction cup fastener mounted thereon to adhere the magnetic body to a surface, said suction cup fastener actuated by a lever perpendicularly protruding from a lateral surface of said magnetic body, the magnetic body including an electromagnet and a motion detector housed therein, the electromagnet including a battery, said electromagnet creating a magnetic field actuated by the motion detector; and b) a wearable wristband to actuate the battery of the electromagnet via a power button; and c) a pool, wherein said magnetic body includes two magnetic bodies, wherein each of said magnetic bodies are mounted on opposing sides of the pool; and d) a wearable strap assembly including a pair of strap magnets that interact with said electromagnet, wherein each strap magnet of said pair of strap magnets is configured to be fastened to an ankle of a swimmer, the pair of strap magnets restricting the movement of the swimmer by interacting with said electromagnet via an electromagnetic force.

* * * * *